US009583806B2

(12) United States Patent
Cho et al.

(10) Patent No.: US 9,583,806 B2
(45) Date of Patent: Feb. 28, 2017

(54) MULTI-BAND PASS FILTER

(75) Inventors: Hak Rae Cho, Incheon (KR); Su Duk Seo, Incheon (KR)

(73) Assignee: Innertron Co., Ltd., Incheon (KR)

( * ) Notice: Subject to any disclaimer, the term of this patent is extended or adjusted under 35 U.S.C. 154(b) by 198 days.

(21) Appl. No.: 14/123,045

(22) PCT Filed: Mar. 22, 2012

(86) PCT No.: PCT/KR2012/002061
§ 371 (c)(1),
(2), (4) Date: Oct. 16, 2014

(87) PCT Pub. No.: WO2013/118938
PCT Pub. Date: Aug. 15, 2013

(65) Prior Publication Data

US 2015/0042419 A1 Feb. 12, 2015

(30) Foreign Application Priority Data

Feb. 6, 2012 (KR) ..... 10-2012-0011574

(51) Int. Cl.
*H01P 7/06* (2006.01)
*H01P 1/203* (2006.01)
(Continued)

(52) U.S. Cl.
CPC ..... *H01P 1/203* (2013.01); *H01P 1/208* (2013.01); *H01P 1/2082* (2013.01)

(58) Field of Classification Search
CPC ..... H01P 1/205; H01P 1/20532; H01P 7/04
(Continued)

(56) References Cited

U.S. PATENT DOCUMENTS 5,132,651 A * 7/1992 Ishikawa ..... H03H 11/04 333/134
5,256,997 A * 10/1993 Inagaki ..... H03H 7/06 333/167
(Continued)

FOREIGN PATENT DOCUMENTS

JP 2009-538005 A 10/2009
KR 10-2008-0076238 A 8/2008
(Continued)

OTHER PUBLICATIONS

International Search Report in International Application No. PCT/KR2012/002061 dated Feb. 7, 2013 which cites references 2-5 shown above.

*Primary Examiner* — Dean Takaoka
(74) *Attorney, Agent, or Firm* — Knobbe Martens Olson & Bear LLP

(57) ABSTRACT

An multi-band pass filter is disclosed. The multi-band pass filter in accordance with an embodiment of the present invention includes: a housing comprised with an input terminal and an output terminal separated from each other; a high pass filter installed in one inside of the housing and electrically connected to the input terminal and configured to form a plurality of resonator patterns with the circuit patterns on the printed circuit board; and a dual band reject filter series-connected with the high pass filter and provided between the high pass filter and the output terminal by forming a plurality of cavities inside the housing and furnishing each of the cavities with a resonator.

6 Claims, 7 Drawing Sheets

(51) Int. Cl.
*H01P 1/208* (2006.01)
*H01P 1/207* (2006.01)

(58) Field of Classification Search
USPC ..... 333/206, 207, 222–224, 202
See application file for complete search history.

(56) References Cited

U.S. PATENT DOCUMENTS

| | | | | |
|---|---|---|---|---|
| 5,410,284 | A * | 4/1995 | Jachowski | H01P 1/205 333/202 |
| 5,543,758 | A * | 8/1996 | Wey | H01P 1/205 333/202 |
| 5,774,027 | A * | 6/1998 | Yamamoto | H03H 7/01 333/167 |
| 5,880,649 | A * | 3/1999 | Tai | H01Q 1/241 333/132 |
| 2008/0012662 | A1 * | 1/2008 | Hernandez | H01P 1/203 333/204 |
| 2009/0128260 | A1 | 5/2009 | Block et al. | |

FOREIGN PATENT DOCUMENTS

| | | | |
|---|---|---|---|
| KR | 10-2009-0090825 | A | 8/2009 |
| KR | 10-1090725 | B1 | 12/2011 |

* cited by examiner

MULTI-BAND PASS FILTER

TECHNICAL FIELD

The present invention relates to a multi-band pass filter—more specifically, a multi-band pass filter wherein one high pass filter and at least one band reject filter are series-connected with each other in one housing to facilitate miniaturization and characteristics matching.

BACKGROUND ART

RF filters used in mobile communication bands are divided into low pass filters (LPFs), band pass filters (BPFs), high pass filters (HPFs), and band stop/reject filters (BSF/BRFs). Among them, the use of band pass filters and band reject filters has been increasing recently because of the emergence of many carriers and attempts to use limited frequency resources efficiently.

This is because the roles of band pass filters to select accurately only the desired frequency bands and of band reject filters to pass all frequency bands well except a certain frequency band are directly connected to the sound quality of calls in the contemporary RF mobile communication system wherein many frequencies are minutely divided for use. These principles of filters use frequencies are minutely divided for use. These principles of filters use resonance made by combinations of inductance (L) and capacitance (C). Therefore, band reject filters or band pass filters suitable for use can be embodied by diversely combining inductance components and capacitance components.

As shown in FIGS. 1 and 2, a mobile communication system (10) made pursuant to conventional technologies is equipped with multiple band pass filters (12-16) between its base station system (2) and antenna (4) to pass different frequency bands. The band pass filters (12-16) are parallel-connected with each other to pass different frequency bands (f1, f2, f3). Toward this end, the mobile communication system (10) requires characteristics matching between band pass filters (12-16).

To match the characteristics of the multiple band pass filters (12-16) parallel-connected with each other, the mobile communication system (10) requires a combination device and a split device (20, 30) that will combine or split RF signals at both ends. However, the mobile communication system (10) made pursuant to conventional technologies can hardly be embodied as actual filter products because characteristics matching between parallel-connected band pass filters (12-16) is very difficult.

SUMMARY

The present invention provides a multi-band pass filter that can be miniaturized. An aspect of the present invention features a multi-band pass filter, which includes: a housing comprised with an input terminal and an output terminal separated from each other; a high pass filter installed in one inside of the housing and electrically connected to the input terminal and configured to form a plurality of resonator patterns with the circuit patterns on the printed circuit board; and a dual band reject filter series-connected with the high pass filter and provided between the high pass filter and the output terminal by forming a plurality of cavities inside the housing and furnishing each of the cavities with a resonator.

The dual band reject filter may include the first band reject filter series-connected with the high pass filter by arranging some of the cavities to be adjacent to the high pass filter and comprising transmission lines installed side by side with a plurality of resonators inside the some of the cavities; and the second band reject filter series-connected with the first band reject filter through transmission lines installed side by side with a plurality of resonators inside the remaining cavities arranged between the first band reject filter and the output terminal.

The first band reject filter may reject frequency bands larger than the frequency band of the high pass filter, and configures to reject frequency bands smaller than the frequency band of the second band reject filter.

The housing may include a plurality of grooves formed on the housing in top to bottom direction to comprise the housing with the cavities; wherein the cavities are arranged in a plurality of rows and a plurality of columns, and; wherein a plurality of passageways are formed to connect the cavities located at the two ends of each of the rows or the columns with each other to correspond to the signal transmission path.

Any one of the passageways may connect the first band reject filter and the second band reject filter.

Each of the passageways may be installed with a transmission line for signal transmission between the abovementioned cavities located at two ends. [16] Each of the first and second band reject filters may be adjusted in the frequency bands rejected by it and the intensity of the stop bands according to at least one of the following: number of the cavities, number of the resonators, sizes of the resonators, thickness of the transmission lines, distances between the resonators and transmission lines, and cross-sectional area of the transmission lines.

DETAILED DESCRIPTION

Figure 1:
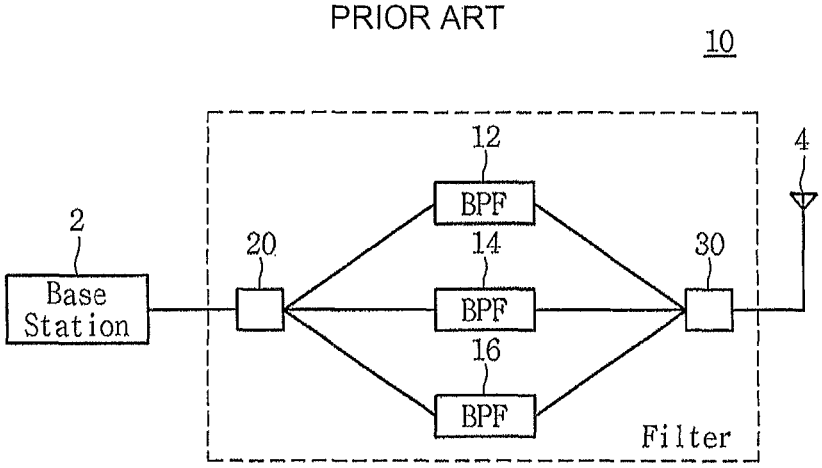
FIG. 1 PRIOR ART
FIG. 1 illustrates the construction of a band pass filter for passing different frequency bands according to conventional technologies.
Figure 2:
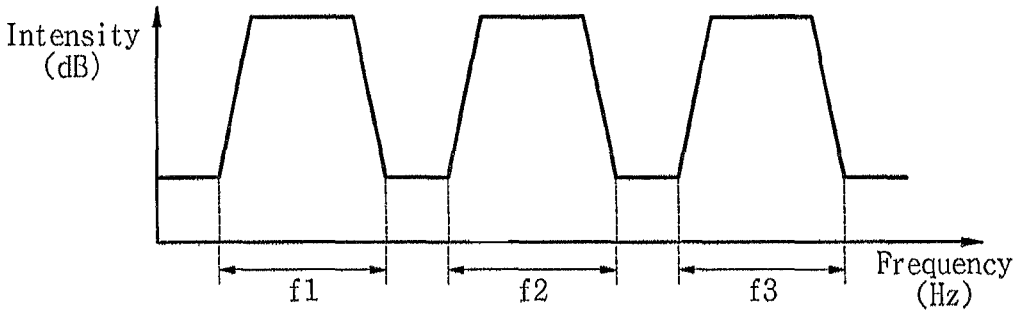
FIG. 2 PRIOR ART
FIG. 2 is a wave form diagram showing the expected characteristics of the multi-band pass filter illustrated in FIG. 1.

The examples of embodiment of the present invention can be modified into various forms, and the scope of the present invention should not be interpreted as being limited to the examples of embodiment described below. These examples of embodiment are provided to explain the present invention more completely to those who have average knowledge in the industry. Therefore, the shapes of components, etc., in the drawings have been exaggerated for clearer explanations.

Hereinafter, referring to attached FIGS. 3 to 9, examples of embodiment of the present invention are explained in detail.

Figure 3:
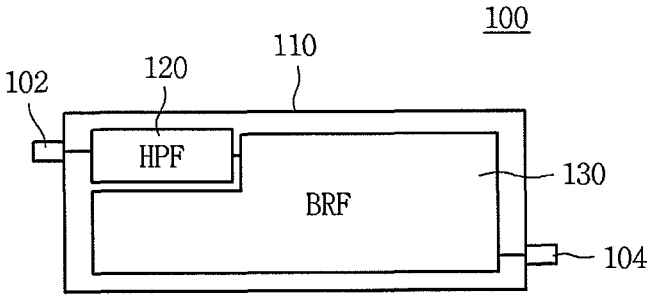
FIG. 3 shows the construction of the multi-band pass filter according to the present invention.
Figure 4:
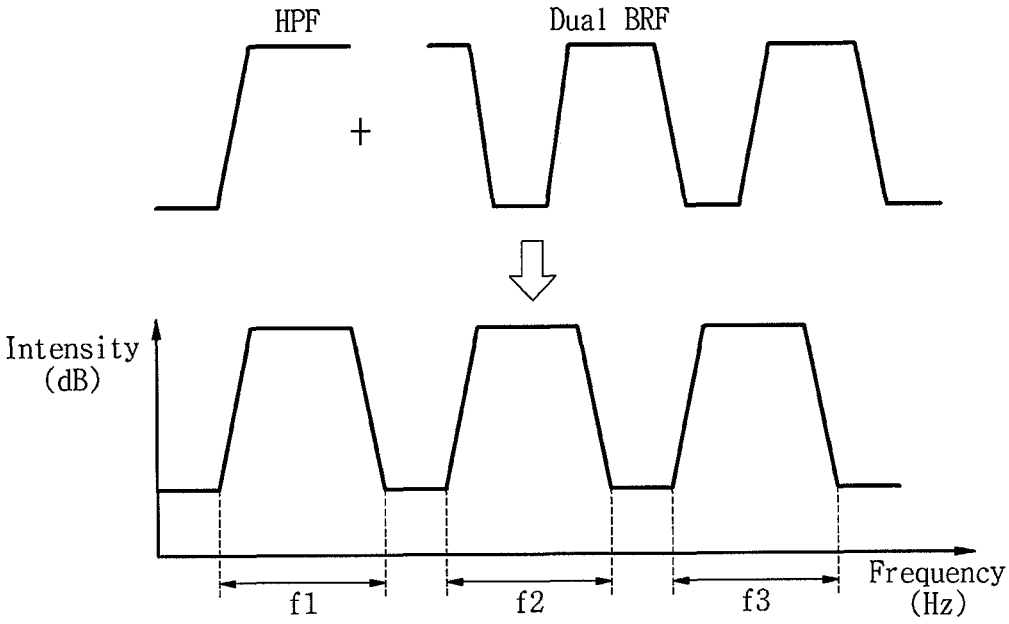
FIG. 4 is a wave form diagram showing the expected characteristics of the multi-band pass filter illustrated in FIG. 3.

FIG. 3 illustrates the rough construction of the multi-band pass filter according to the present invention. FIG. 4 is a wave form diagram showing the expected characteristics of the multi-band pass filter illustrated in FIG. 3.

According to FIG. 3, the multi-band pass filter (100) is comprised of a housing (110) opened on top and one high pass filter (120) and at least one band reject filter (130) installed in the housing (110). The multi-band pass filter (100) also has a housing cover (not illustrated) to cover the top of the housing (110).

The housing (110) is furnished with one input terminal (102) and one output terminal (104). In the multi-band pass filter (100), one high pass filter (120) and at least one band reject filter (130) are series-connected with each other between the input terminal (102) and the output terminal (104) in the housing (110).

This multi-band pass filter (100) can pass RF signals in different frequency bands (f1, f2, f3) according to the number of band reject filters (130), because certain frequency bands of RF signals filtered by the high pass filter (120) are rejected through at least one band reject filter (130) as illustrated in FIG. 4. This provides the effect of enabling passing different frequency bands using one multi-band pass filter (100) in a mobile communication system. For instance, this can solve the necessity of passing different frequency bands for individual multiple mobile carriers assigned with different frequency bands or the necessity of preparing multiple band pass filters for different uses (for instance, Wibro, 4G, etc.) which use different frequency bands.

In addition, unlike FIG. 3, the multi-band pass filter (100) may be provided by series-connecting at least one band reject filter (130) and one high pass filter (120) with each other inside a housing (110). This multi-band pass filter (100) can provide the same expected characteristics as shown in FIG. 4 because of frequency reversibility.

Figure 5:
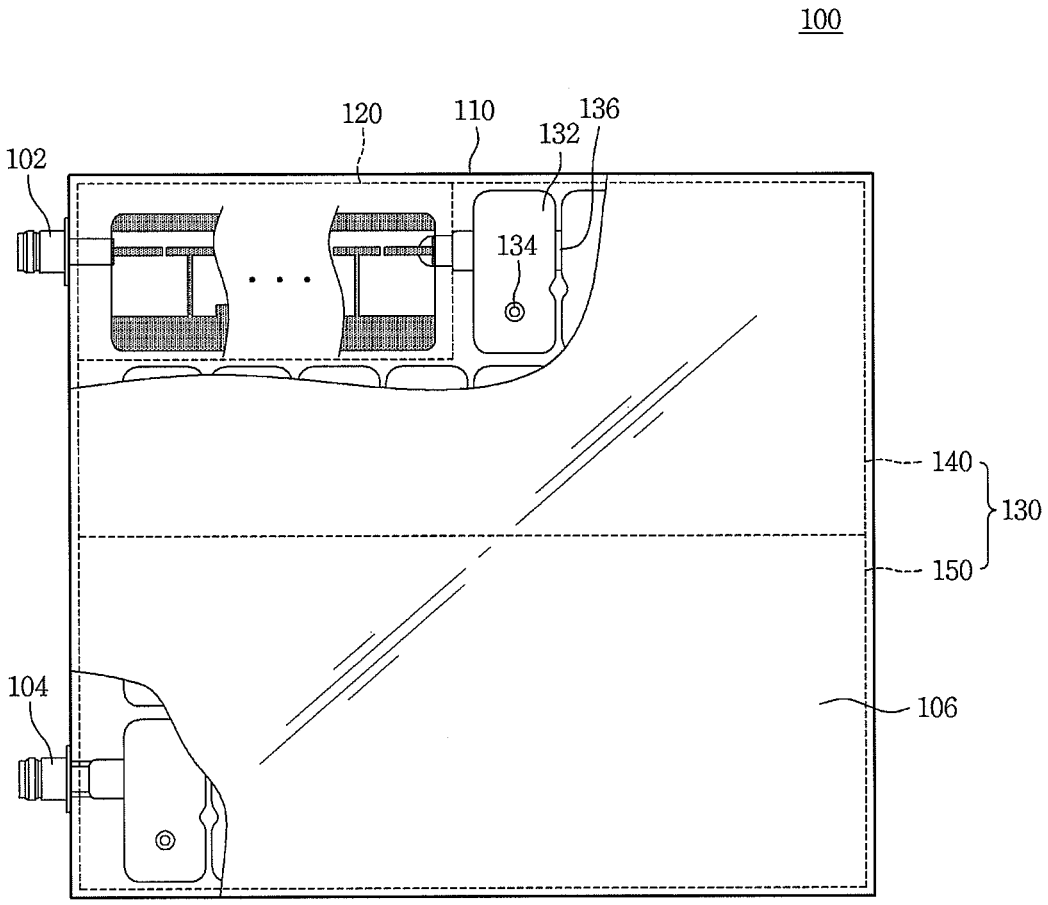
FIG. 5 shows the construction of the multi-band pass filter according to an example of embodiment of the present invention.
Figure 6:
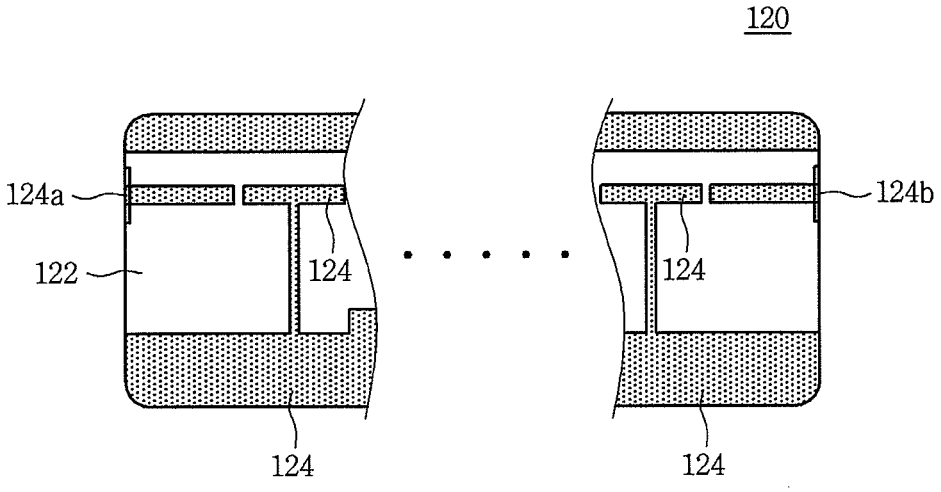
FIG. 6 shows the detailed construction of the high pass filter illustrated in FIG. 5.
Figure 7:
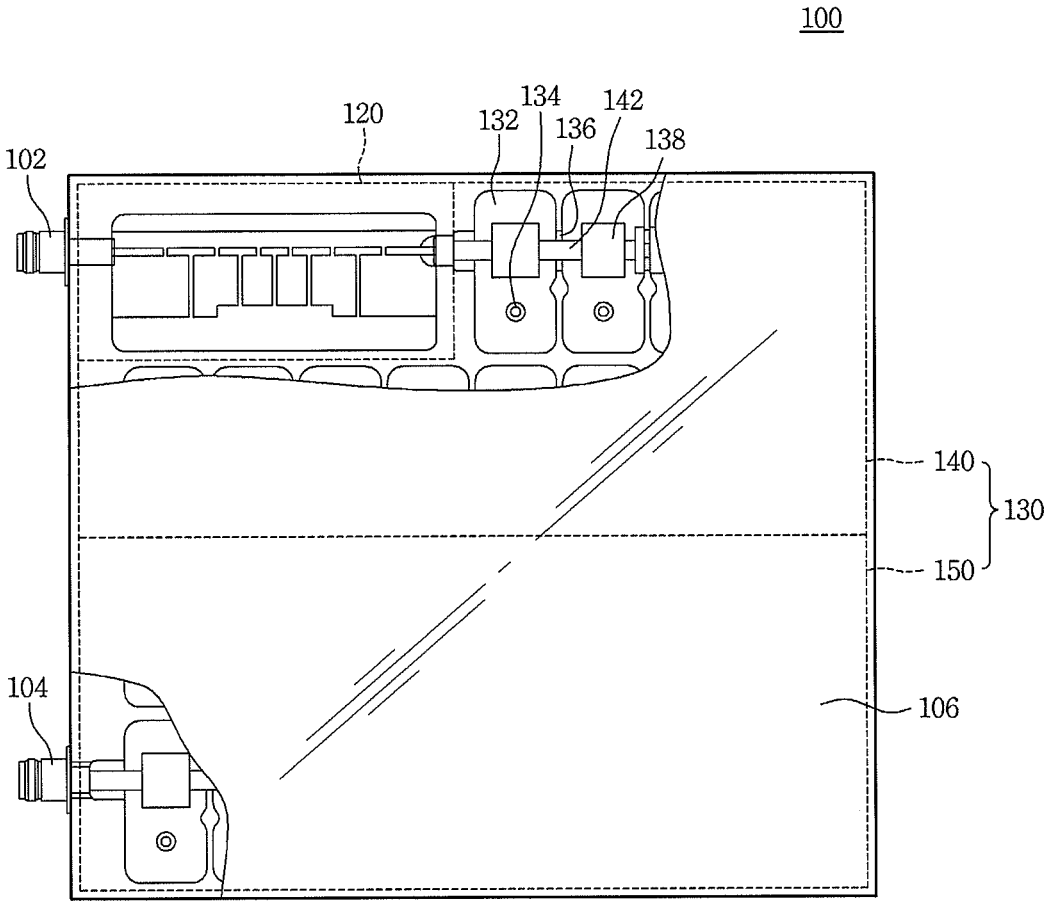
FIG. 7 shows the detailed construction of the dual band reject filter illustrated in FIG. 5.

FIG. 5 shows the construction of the multi-band pass filter according to an example of embodiment of the present invention. FIG. 6 illustrates the detailed construction of the high pass filter shown in FIG. 5, whereas FIG. 7 shows the detailed construction of the dual band reject filter illustrated in FIG. 5.

As shown in FIG. 5, the multi-band pass filter (100) according to an example of embodiment of the present invention is comprised of a cover (106) furnished with one input terminal (102) and one output terminal (104), a housing (110), and one high pass filter (HPF)(120) and two band reject filters, i.e., a dual band reject filter (dual BRF) (130: 140, 150) inside the housing (110). The high pass filter (120) and the dual band reject filter (130) are series-connected with each other between the input terminal (102) and the output terminal (104).

The housing (110) is prepared in a rectangular parallelepiped metal opened on the top and is furnished with an input terminal (102) and an output terminal (104) for signal transmission. A cover (106) is attached to the open top of the housing (110). Each of the input terminal (102) and the output terminal (104) is installed from the outside to the inside of the housing (110). The input terminal (102) is electrically connected to the circuit pattern of the high pass filter (120) inside the housing (110), and the output terminal (104), to the dual band reject filter (130) inside the housing (110). In this example of embodiment, the input terminal (102) and the output terminal (104) are separately installed on the same side of the housing (110).

The housing (110) provides a space for high pass filter (120) installation inside close to the input terminal (102), including a space for dual band reject filter (130) installation on the remaining area inside. A plurality of cavities (132) are formed in the remaining area of the housing (110) in a structure wherein they are arranged transversely and longitudinally. In other words, the cavities (132) are arranged to have a plurality of rows and columns on the remaining area inside the housing (110). Each of the cavities (132) is furnished in the form of a groove so that partitions (136) are formed between adjacent cavities and is formed to be lengthy from top to bottom of the housing (110).

In this example of embodiment, the cavities (132) are arranged transversely and longitudinally to have a plurality of rows and columns. The cavities (132) are series-coupled with each other. At this time, some of the cavities (132) constituting the dual band reject filter (130) are composed of the first band reject filters (140), and the remaining ones consist of the second band reject filters (150). Some of the partitions between adjacent cavities (132) are opened to furnish partitions (136) wherein windows have been formed, with a resonator (134) installed in each of the cavities (132).

Furthermore, the housing (110) provides a plurality of passageways (142 in FIG. 7) to series-couple those cavities arranged on different rows (or columns) among the cavities (132). Each of the passageways (142) is provided in the form of a groove to connect the cavities arranged at the ends of different rows (or columns) with each other. In addition, each of the passageways (142) has a transmission line (not illustrated) mounted for coupling the relevant cavities. In particular, certain passageways (142) are equipped with transmission lines for electrically connecting the first and second band reject filters (140, 150) inside the housing. Therefore, the cavities (132) are series-connected with each other and coupled in zigzag directions.

The high pass filter (HPF) (120) is installed on one side, i.e., close to the input terminal (102) inside the housing (110). One end (124*a* in FIG. 6) of the high pass filter (120) is electrically connected to the input terminal (102) on one side inside the housing (110), and the other end (124*b* of FIG. 6), to the dual band reject filter (130).

As illustrated in FIG. 6, the high pass filter (120) has a circuit pattern (124) formed on the printed circuit board (122). The circuit pattern (124) forms the transmission lines and a plurality of resonator patterns. For instance, the high pass filter (120) forms the transmission lines and resonator patterns with conductive microstrip circuit patterns (124) on the dielectric substrate (122). In this high pass filter (120), microstrip circuit patterns (124) are made by silver-plating one side of the dielectric substrate (122) to a certain thickness (for instance, approximately 10 μm); the transmission lines and resonator patterns that pass the desired high frequency bands are designed by adjusting the spaces between these microstrip circuit patterns (124) and the width, length, etc., of the microstrip circuit patterns (124).

The dual band reject filter (dual BRF) (130) consists of the first and second band reject filters (140, 150). The first and second band reject filters (140, 150) reject different frequency bands. For instance, the first band reject filter (140) rejects lower frequency bands than the second band reject filter (150). Of course, the first band reject filter (140) may reject higher frequency bands than the second band reject filter (150) in some cases.

Each of the first and second band reject filters (140, 150) is furnished with the cavities (132), and each of the cavities (132) is equipped with a resonator (134). The resonators (134) are furnished in the form of bars or rods and installed vertically from top to bottom of the cavities (132). For instance, the resonators (134) of the first band reject filter (140) are furnished as low bandstop resonators that reject low band frequencies, and the resonators (134) of the second band reject filter (150), as high bandstop resonators that reject high band frequencies. In this example of embodiment, the resonators (134) of the first band reject filter (140) have smaller (i.e., smaller cross-sectional area) structures than the resonators (134) of the second band reject filter (150).

As illustrated in FIG. 7, each of the first and second band reject filters (140, 150) is equipped with transmission lines (138) for signal transmission. The transmission lines (138) are installed on windows made by opening some of the partitions (136) and arranged on the sides of the resonators (134). Therefore, the transmission lines (138) are arranged side by side with the resonators (134). The transmission lines (138) are inserted inside each of the passageways (142) to couple the relevant resonators.

Each of the transmission lines (138) is furnished in a metal material, for instance, and the two ends of each are connected to the circuit pattern (124*b*) and the output terminal (104) of the high pass filter (120) inside the housing (110). These transmission lines (130) have structures that include coaxial lines electrically connecting the high pass filter (120) and the output terminal (104) and capacitive conductors arranged such that their outer circumference surfaces are at a certain distance from the side surfaces of the resonators (134). The coaxial lines are located on the windows in the partitions (136), and the capacitive conductors are arranged at locations corresponding to the sides of the resonators (134). In other words, the capacitive conductors are furnished on the coaxial lines at locations where resonators (134) are arranged on one side. The capacitive conductors are furnished in the form of cylinders extended laterally from the central axis of the coaxial lines to have larger diameters than the coaxial lines.

Each of these first and second band reject filters (140, 150) may be adjusted in the frequency bands rejected by it and the intensity of the reject bands according to the number of cavities (132), number of resonators (134), sizes of the resonators (134), thickness of the transmission lines (138), distances between the resonators (134) and transmission lines (138), and cross-sectional area of the transmission lines (138). In this example of embodiment, the first band reject filter (140) is furnished with smaller number of cavities (132) and resonator (134) than the second band reject filter (150).

Figure 8:
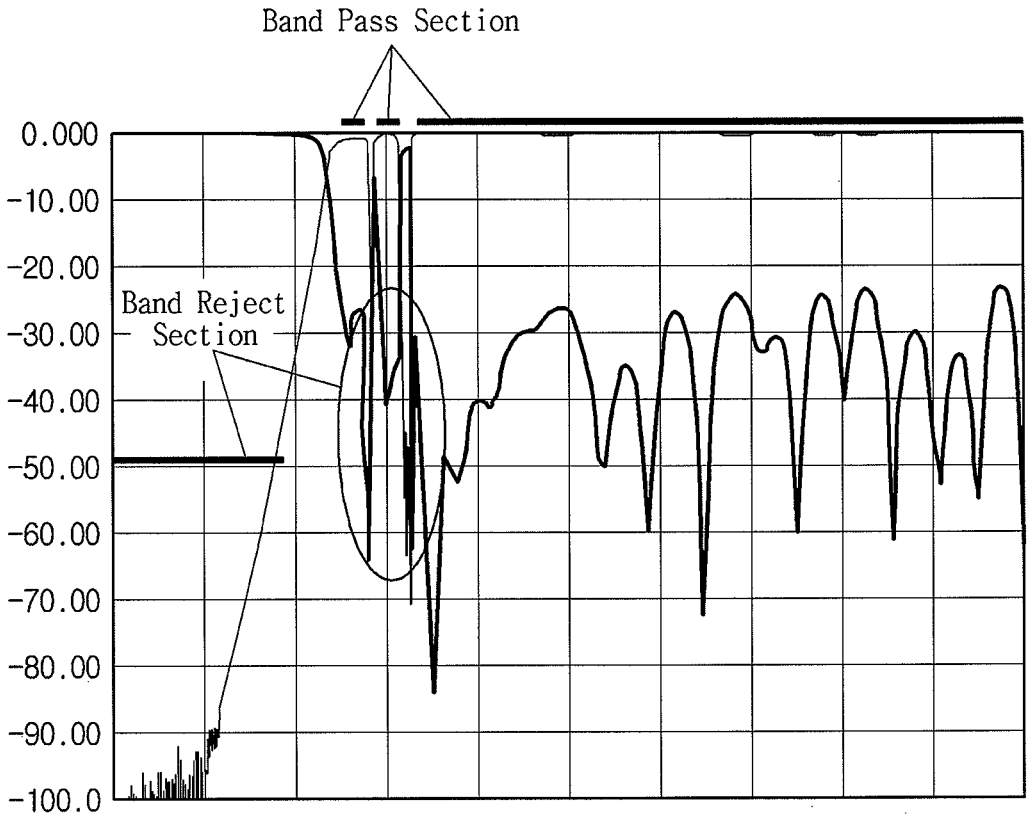
FIG. 8 is a wave form diagram showing the frequency characteristics of the multi-band pass filter illustrated in FIG. 5.

As illustrated in FIG. 8, the multi-band pass filter (100)—in this example of embodiment—forms three band pass sections that pass different frequency bands in substance, because high band RF signals passed by the high pass filter (120) are made to form two band reject sections by the first and second band reject filters (140, 150).

Therefore, the multi-band reject filter (100) in the present invention can facilitate characteristics matching and pass different frequency bands; it can be miniaturized because one high pass filter (120) formed in printed circuit board type and at least one band reject filter (130: 140, 150) formed in resonator type are series-connected with each other inside one housing (110).

Figure 9:
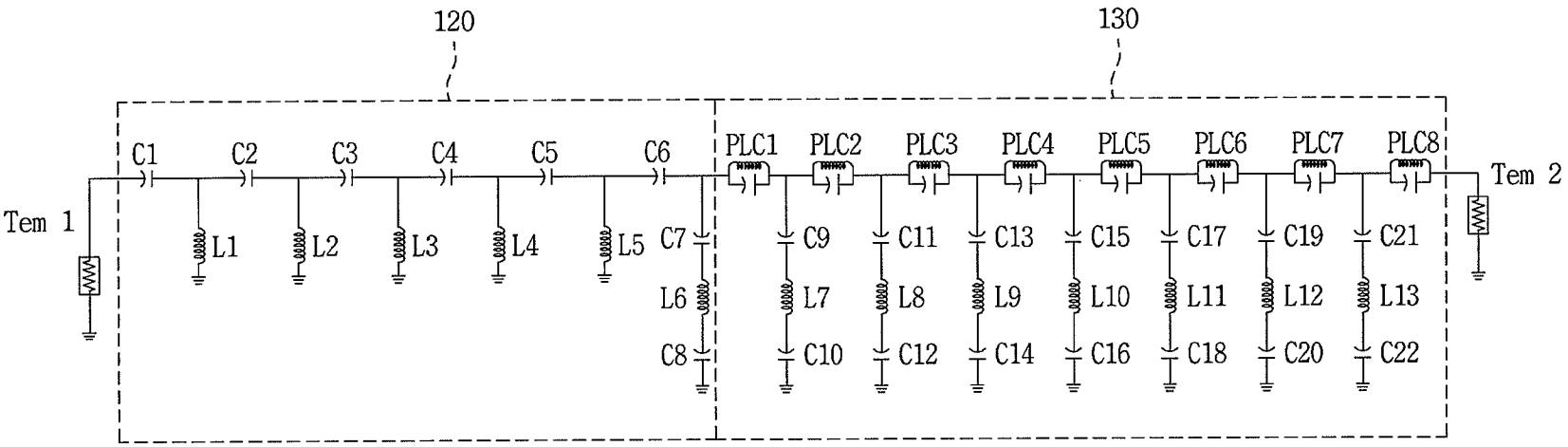
FIG. 9 is a diagram of a circuit formed by the construction of the multi-band pass filter according to another example of embodiment of the present invention.

FIG. 9 is a diagram of a circuit formed by the construction of the multi-band pass filter according to another example of embodiment of the present invention. Although the dual band reject filter in the circuit diagram in this example of embodiment is furnished with eight resonators, it is clear that the circuit diagram should be changed in line with the number of resonators.

According to FIG. 9, the multi-band reject filter (100) forms input and output terminations (Term1, Term2) having impedance of, for instance, approximately 50 ohms at the two ends connected to the input terminal (102) and the output terminal (104), respectively. The multi-band reject filter (100) is also furnished with a high pass filter (120) and a dual band reject filter (130: 140, 150) between its input and output terminations (Term1, Term2).

The high pass filter (120) is formed by the circuit patterns on the printed circuit board and is composed of a plurality of capacitors (C1-C6) and a plurality of inductors (L1-L5) formed between each of the capacitors (C1-C6). The inductors (L1-L5) are parallel-connected with each other and series-connected with each of the capacitors (C1-C6). In the high pass filter (120), a plurality of capacitors (C7, C8) and one inductor (L6) series-connected with each other are formed in the part where the high pass filter (120) is connected with the dual band reject filter (130).

The dual band reject filter (130) includes a plurality of LC parallel resonance circuits (PLC1-PLC8) formed by transmission lines (138) and a plurality of LC series resonance circuits (C9, L7, C10-C21, L13, C22) formed by each of the resonators (134).

In each of the LC parallel resonance circuits (PLC1-PLC8), one inductor and one capacitor are parallel-connected with each other. The LC series resonance circuits (C7, L6, C8-C21, L13, C22) are formed between LC parallel resonance circuits (PLC1-PLC8) adjacent to each other and between grounds. In each of the LC series resonance circuits (C7, L6, C8-C21, L13, C22), one inductor (L7-L13) and two capacitors (C7-C11) are series-connected with each other. In other words, each inductor (L7-L11) is located between two capacitors.

As described above, the multi-band pass filter (100) in the present invention passes different frequency bands by series-connecting one high pass filter (120) and at least one band reject filter (130: 140, 150) with each other in one housing (110).

Although the construction and actions of the multi-band pass filter according to the present invention were described in detail and illustrated with drawings as above, these are only explanations with some examples of embodiment. The multi-band pass filter in the present invention can be diversely changed and/or modified without veering away from the technical idea of the present invention.

What is claimed is:

1. A multi-band pass filter passing different frequency bands, comprising:

a housing comprised with an input terminal and an output terminal separated from each other;

a high pass filter installed in one inside of the housing and electrically connected to the input terminal and configured to form a plurality of resonator patterns with circuit patterns on a printed circuit board; and a dual band reject filter serially connected with the high pass filter and provided between the high pass filter and the output terminal by forming a plurality of cavities inside the housing and furnishing each of the plurality of cavities with each of a plurality of resonators, wherein the dual band reject filter comprises:

a first band reject filter serially connected with the high pass filter by arranging some of the plurality of cavities to be adjacent to the high pass filter and comprising transmission lines installed side by side with some of the plurality of resonators inside the some of the plurality of cavities; and a second band reject filter serially connected with the first band reject filter through transmission lines installed side by side with remaining resonators of the plurality of resonators inside remaining cavities of the plurality of cavities arranged between the first band reject filter and the output terminal.

2. The multi-band pass filter of claim 1, wherein the first band reject filter rejects frequency bands larger than the frequency band of the high pass filter, and is configured to reject frequency bands smaller than the frequency band of the second band reject filter.

3. The multi-band pass filter of claim 1, wherein the housing comprises a plurality of grooves formed on the housing in top to bottom direction to provide the housing with the cavities, wherein the cavities are arranged in a plurality of rows and a plurality of columns, and wherein a plurality of passageways are formed to connect certain cavities located at two ends of each of the rows or the columns with each other to correspond to the signal transmission path.

4. The multi-band pass filter of claim 3, wherein any one of the passageways connects the first band reject filter and the second band reject filter.

5. The multi-band pass filter of claim 3, wherein each of the passageways is installed with a transmission line for signal transmission between the cavities located at the two ends.

6. The multi-band pass filter of claim 2, wherein each of the first and second band reject filters is adjusted in the frequency bands rejected by it and an intensity of the stop bands according to at least one of the following: number of the cavities, a number of the resonators, sizes of the resonators, a thickness of the transmission lines, a distances between the resonators and the transmission lines, and a cross-sectional area of the transmission lines.

* * * * *